United States Patent [19]

Leanna et al.

[11] 4,165,688

[45] Aug. 28, 1979

[54] INK DAM FOR PRINTING PRESS

[75] Inventors: Dale D. Leanna, Little Suamico; Allen R. Jorgensen, Townsend, both of Wis.

[73] Assignee: Magna-Graphics Corporation, Oconto Falls, Wis.

[21] Appl. No.: 914,751

[22] Filed: Jun. 12, 1978

Related U.S. Application Data

[63] Continuation of Ser. No. 787,434, Apr. 14, 1977, abandoned.

[51] Int. Cl.[2] ..... B41F 31/06

[52] U.S. Cl. ..... 101/207; 101/210; 101/363

[58] Field of Search ..... 101/205, 206, 207, 208, 101/210, 350, 363, 364, 366, 148; 118/258, 259, 407

[56] References Cited

U.S. PATENT DOCUMENTS

| | | | |
|---|---|---|---|
| 2,218,945 | 10/1940 | Andersson | 101/364 |
| 2,442,700 | 6/1948 | Luehrs | 101/364 |
| 2,744,464 | 5/1956 | Harless | 101/210 X |
| 2,887,050 | 5/1959 | Moser et al. | 101/364 |
| 3,032,007 | 5/1962 | McCauliff | 101/210 X |
| 3,585,932 | 6/1971 | Granger | 101/208 |

FOREIGN PATENT DOCUMENTS

| | | | |
|---|---|---|---|
| 924401 | 4/1963 | United Kingdom | 101/210 |

*Primary Examiner*—J. Reed Fisher

*Attorney, Agent, or Firm*—James E. Nilles

[57] ABSTRACT

A printing press ink fountain has means for applying different colored inks to different sections of a circumferentially grooved fountain roll for subsequent transfer to an anilox roll, printing cylinder, and moving web. Ink dams or dividers, each having a hole through which the fountain roll extends, divide the ink fountain into separate ink compartments and cooperate with the fountain and anilox rolls to prevent ink transfer between adjacent sections on each roll. Each divider has a circumferential edge around its hole which extends into a fountain roll groove. Each divider also has a grooved edge which rides against the anilox roll. Air ports are provided along these edges and compressed air is expelled therethrough to provide air seals to prevent ink transfer along the rolls. A resilient hollow pneumatically operated tube between the bottom of each divider and the ink fountain provides a mechanical seal between adjacent ink fountain compartments and also biases the grooved edge of the divider against the anilox roll in a tight mechanical seal.

7 Claims, 9 Drawing Figures

INK DAM FOR PRINTING PRESS

REFERENCE TO RELATED CO-PENDING APPLICATION

This application is a continuation of patent application Ser. No. 787,434, filed Apr. 14, 1977 and now abandoned.

BACKGROUND OF THE INVENTION

1. Field of Use

This invention relates generally to ink dams for printing presses. In particular, it relates to a flexographic multicolor printing press wherein the ink fountain has means for applying different colored inks to different sections of a circumferentially grooved fountain roll for subsequent transfer to an anilox roll, printing cylinder, and moving web and wherein ink dams or dividers, each having a hole through which the fountain roll extends, divide the ink fountain into separate ink compartments and cooperate with the fountain and anilox rolls to prevent ink transfer between adjacent sections on each roll.

2. Description of the Prior Art

Some flexographic printing presses include an ink fountain having means to apply ink to a fountain roll for subsequent transfer to an anilox roll, printing cylinder, and moving web. Typically, the ink fountain extends substantially the entire length of the rolls in the press. If it is desired to print using inks of different colors across the web, or to print on a web which is narrower than the length of the ink fountain, it is the practice to divide the fountain into separate compartments by means of ink dams or dividers which are constructed so as to divide the fountain into separate compartments, to maintain a fluid-tight seal between compartments in the fountain, and to maintain a seal against the fountain roll. The prior art contains numerous examples of such dividers and the following U.S. Pat. Nos. illustrate the state of the art: 3,831,517; 3,635,161; 2,887,050; 2,525,363; and 2,442,700.

In some prior art arrangements, the ink dam or divider has edges confronting the fountain roll and the floor of the ink fountain pan and resilient sealing means are disposed along the edge confronting the fountain roll to form a seal. One of the difficulties with such prior art arrangements is that the friction between the fountain roll and the sealing means eventually results in wearing down of the sealing means thereby allowing ink to leak past the sealing means thereby contaminating ink in an adjacent compartment or allowing ink to be applied to a section of the roll whereat it is not desired. This problem is aggravated in certain industries where inks of very low viscosity, almost as thin as water, are employed. Prior art attempts to overcome this problem have not always been successful, and consequently, it is necessary in some industries to avoid the problem entirely by turning to different methods of producing printed material.

For example, in the manufacture of paper toweling, it has heretofore been the practice to imprint a relatively wide web of material (on the order of eight to ten feet wide) in a flexographic printing press which applies spaced apart bands or designs of the same color on the web and then to subsequently split the web and form separate rolls of paper toweling each having the same color imprinted thereon. A separate press (or the same press set up for a different colored ink) is then used to produce rolls of paper toweling of other colors. Manual labor is then employed to select rolls of different colors and pack them in a shipping container whereby the purchaser has a selection of different colored rolls available. This procedure is time-consuming and costly.

SUMMARY OF THE INVENTION

In accordance with the present invention, there is provided a flexographic multicolor printing press for applying patterns or images of different colored inks to a continuously moving web. The printing press ink fountain has means for applying different colored inks to different sections of a circumferentially grooved fountain roll for subsequent transfer to an anilox roll, printing cylinder, and moving web. Ink dams or dividers, each having a hole through which the fountain roll extends, divide the ink fountain into separate ink compartments and cooperate with the fountain and anilox rolls to prevent ink transfer between adjacent sections on each roll. Each divider has a circumferential edge around its hole which extends into a fountain roll groove. Each divider also has a grooved edge which rides against the anilox roll. Air ports are provided along these edges and compressed air is expelled therethrough to provide air seals to prevent ink transfer along the rolls. A resilient hollow pneumatically operated tube between the bottom of each divider and the ink fountain provides a mechanical seal between adjacent ink fountain compartments and also biases the grooved edge of the divider against the anilox roll in a tight mechanical seal. Means are provided to effect slight separation between the fountain roll and the anilox roll when the press is in non-printing condition and the pneumatically operated tube operates to maintain the seal between the divider and the anilox roll during this condition. Means are also provided to enable the anilox roll, the fountain roll, the ink fountain, and the ink dam assembly to be moved together as a unit toward and away from the plate cylinder.

A flexographic multicolor printing press having ink dams in accordance with the invention offers several advantages over prior art arrangements. For example, the press may be employed to simultaneously apply several different colors at the same time without danger of one color of ink from flowing from one compartment of the ink fountain to another, or from travelling between one section of the fountain roll to another, or from travelling between one section of the anilox roll to another. Furthermore, each divider has a circumferential edge which extends into a groove in the fountain roll and compressed air admitted into the groove through holes along the circumferential edge effectively isolates one section of the fountain roll from an adjacent section even though there is no mechanical contact or frictional engagement between the divider and fountain roll, as is the case in many prior art arrangements. Similarly, each divider cooperates with the anilox roll in such a manner that there is both a mechanical seal and a compressed air seal between the grooved edge of the divider and the surface of the anilox roll, instead of merely a mechanical seal as in prior art arrangements. The holes in the divider which direct air into the groove in the fountain roll and against the anilox roll are so proportioned sizewise with respect to each other that a uniform air pressure is maintained in the groove around the fountain roll and along a portion of the anilox roll. Furthermore, the arrangement is such as to enable air pressure in the groove to be relatively low thereby reducing overall power requirements in the operation of the press. In addition, each divider is provided with a compressed air-operated sealing means in the form of a pneumatic tube which not only effectively seals one compartment of the ink fountain from another, but enables the divider to self-adjust in its engagement with the anilox roll when the fountain roll and anilox roll are separated or as wear occurs along the grooved edge where the divider meets the surface of the anilox roll. The ink fountain and ink nozzles employed in the present invention apply ink to the fountain roll so that the fountain roll is effectively coated with ink and yet there is no surplus amount of ink in the fountain itself.

The dividers in accordance with the invention, in addition to effectively maintaining a division between inks of different colors, can be used as end dams either in single or multicolor printing operations. Apparatus in accordance with the invention is especially useful in presses which use ink of very low viscosity and can maintain an effective seal under such conditions. Also, because compressed air is used as the seal for the rubber covered fountain roll, instead of mechanical sealing means which rely principally on frictional engagement between components, wear on components and possible damage to the fountain roll is reduced to a minimum and, therefore, replacement of parts and downtime is substantially reduced. The apparatus in accordance with the invention is so constructed that it can be economically manufactured and installed and quickly and easily assembled and disassembled, as required. Other objects and advantages of the invention will hereinafter appear.

DESCRIPTION OF A PREFERRED EMBODIMENT GENERAL ARRANGEMENT

Figure 1:
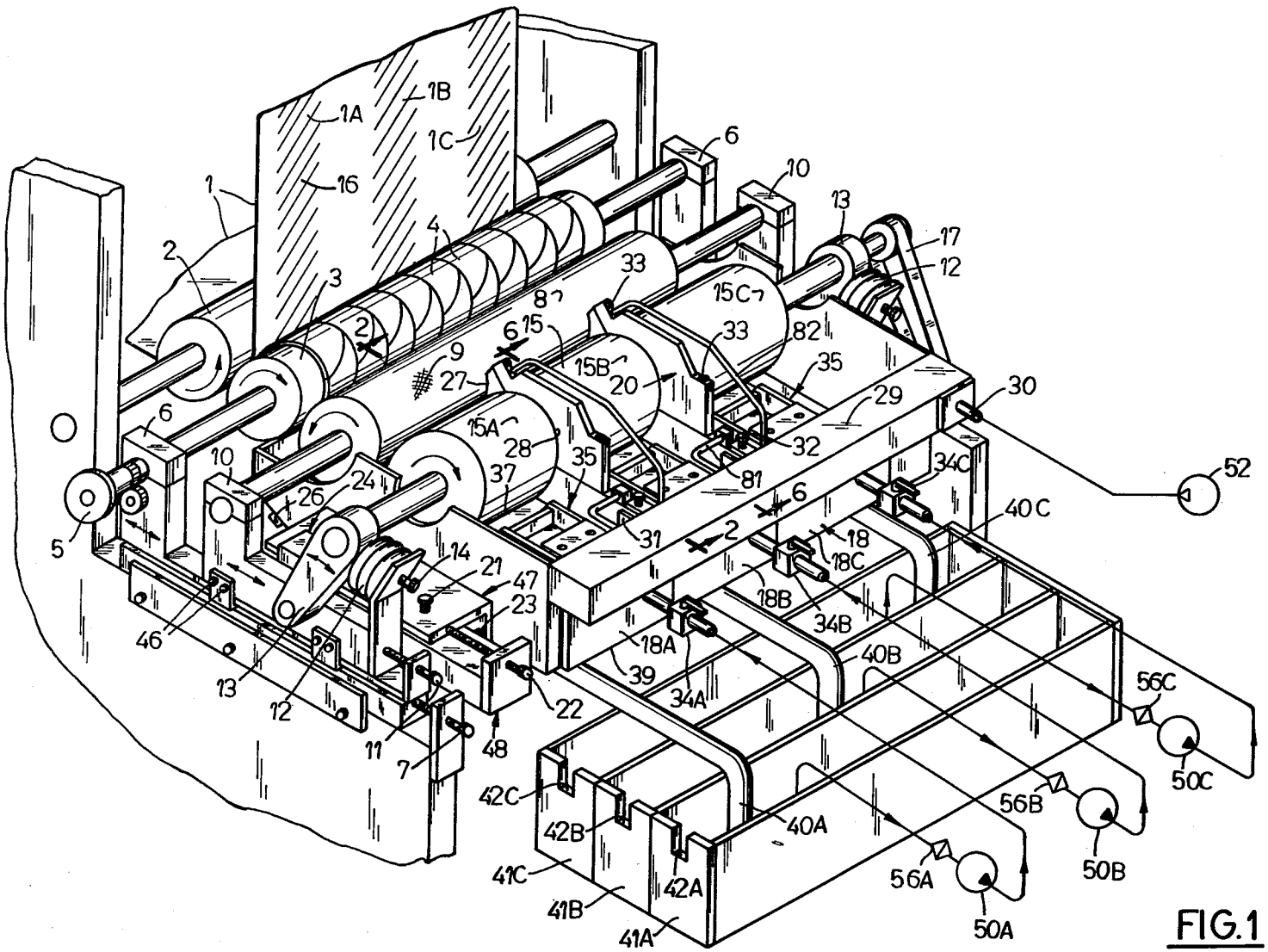
FIG. 1 is a perspective view of a flexographic multicolor printing press having ink dams or dividers in accordance with the present invention.

FIG. 1 shows a portion of a flexographic multicolor printing press in accordance with the invention for imprinting a web 1 with a plurality of bands or patterns of different colored inks, the bands being designated 1A, 1B, and 1C. Web 1 passes between a stationarily mounted rotatable impression cylinder or roll 2 and a printing cylinder or plate roll 3 which has a plurality of printing plates 4 mounted on its periphery. The plates 4 receive ink from an anilox roll 8 which has many minute ink-carrying pockets 9 of different sizes and shapes on the surface thereof for carrying inks of different viscosities. Anilox roll 8 is inked by means of a rubber covered fountain roll 15 which is provided with a pair of spaced apart grooves 28 which divide the roll into three sections 15A, 15B, and 15C. During printing operation, the rolls 2, 3, 8, and 15 are in contact and are driven by means of a suitable conventional drive mechanism (not shown). During a non-printing operation, the plate roll 3 and anilox roll 8 are separated and fountain roll 15 is driven by means of a Sunday drive mechanism 17, including a drive belt 17A and a pulley 17B attached to one end thereof, which automatically comes into play to keep the fountain roll 15 and anilox roll 8 rotating to prevent ink drying. Furthermore, the anilox roll 8 and the fountain roll 15 can be separated during a non-printing operation.

Means are provided, as hereinafter described, for rotatably mounting and for adjusting the positions of rolls 3, 8, and 15.

The press comprises an ink fountain 18 above which the fountain roll 15 and the anilox roll 8 are located. Means are provided to divide the ink fountain 18 into three separate sealed compartments 18A, 18B, and 18C, each for a different colored ink, and for keeping separate the inks which are applied to fountain roll 15 and anilox roll 8. Such means include a pair of spaced apart ink dams or dividers 20 which are mounted on ink fountain 18 and cooperate with the grooves 28 in fountain roll 15 and with the anilox roll 8 as hereinafter explained.

Means are provided to supply a different colored ink to each of the three sections 15A, 15B, and 15C of the fountain roll 15 and comprise ink nozzles 35A, 35B, and 35C, respectively, which are supplied with ink through shut-off valves 34A, 34B, and 34C by means of ink pumps 50A, 50B, and 50C, respectively. The compartments 18A, 18B, and 18C of the ink fountain 18 are connected by drains 40A, 40B, and 40C, respectively, to separate ink reservoirs 41A, 41B, and 41C, respectively, and the latter are connected to the ink pumps 50A, 50B, and 50C, respectively, which return the inks through the ink nozzles 35A, 35B, and 35C, respectively.

Figure 9:
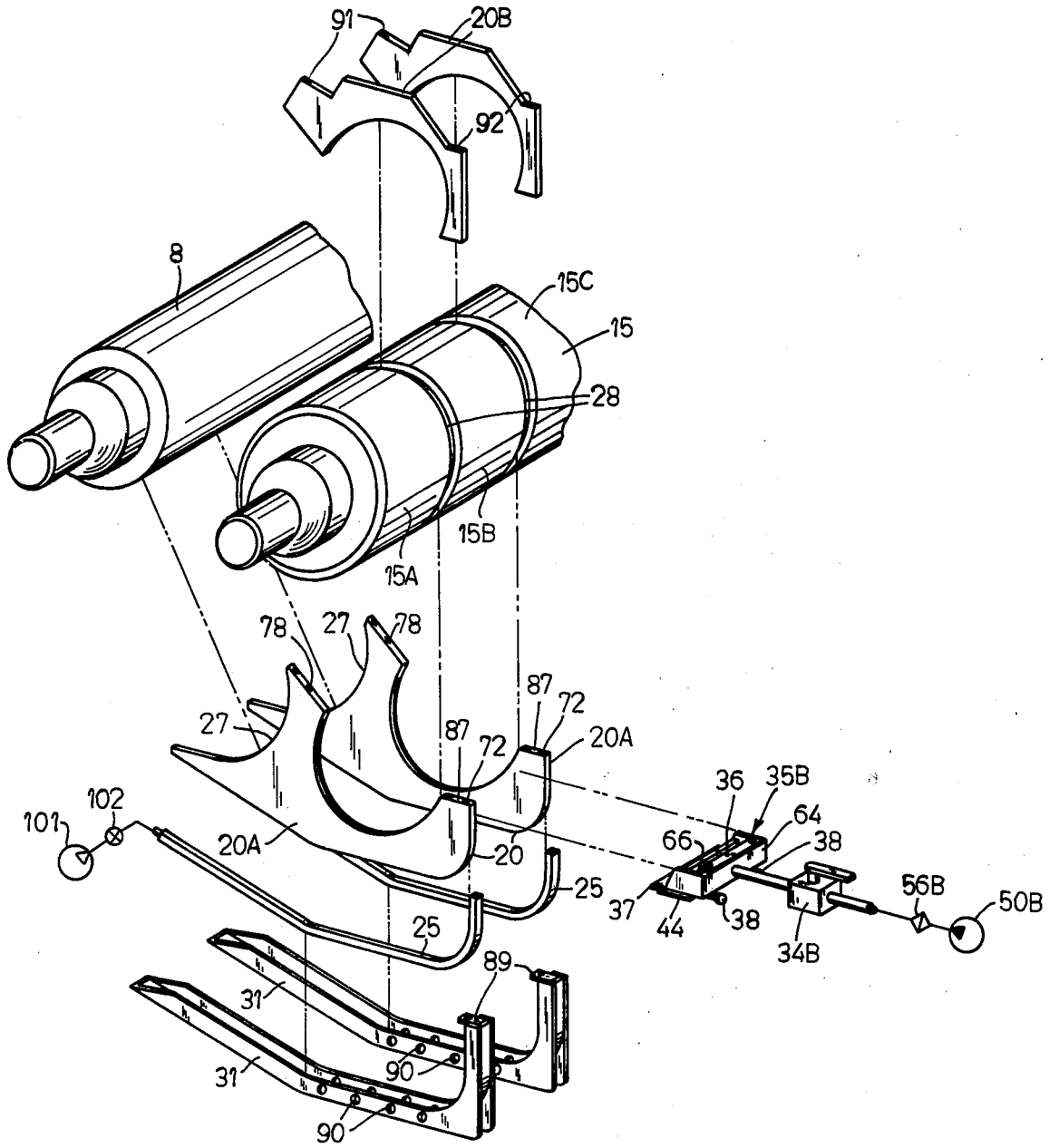
FIG. 9 is an exploded view of the fountain roll, anilox roll, dividers, pneumatic sealing means, and ink nozzle shown in FIGS. 1, 2, 3, and 4.

As FIG. 9 shows, each groove 28 on the fountain roll 15 is associated with and accommodates a divider 20. Each divider 20 comprises a lower section 20A and an upper section 20B and each is provided with internal air passages, hereinafter described, to which air is supplied by means of an air pump 52 and an air manifold 29. Some air passages in divider 20 discharge compressed air into groove 28 in fountain roll 15 to prevent ink transfer between adjacent sections 15A, 15B, 15C of the roll as hereinafter explained. Other air pasages in divider 20 discharge air against a portion of the anilox roll 8 to prevent ink transfer from one section to another therealong, as hereinafter explained.

Figure 2:
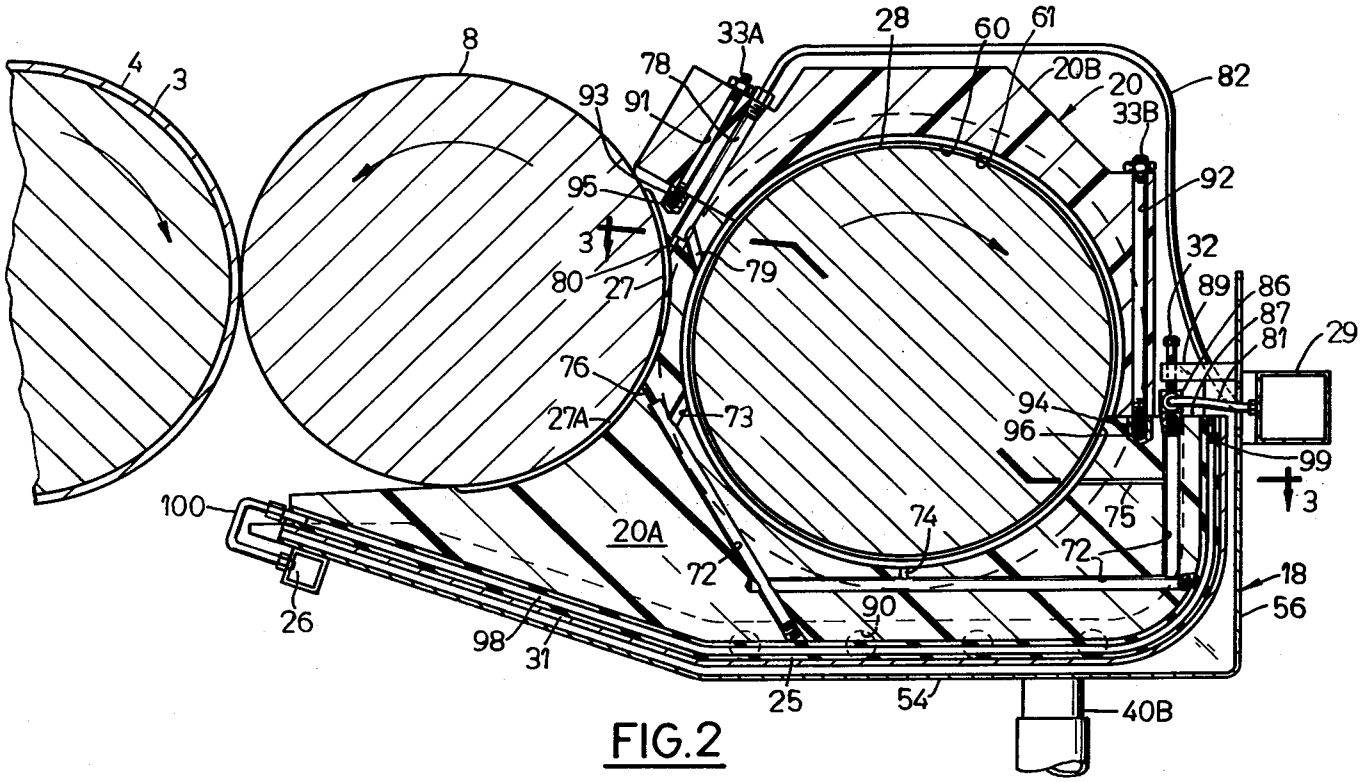
FIG. 2 is an enlarged cross-sectional view taken on line 2—2 of FIG. 1.
Figure 4:
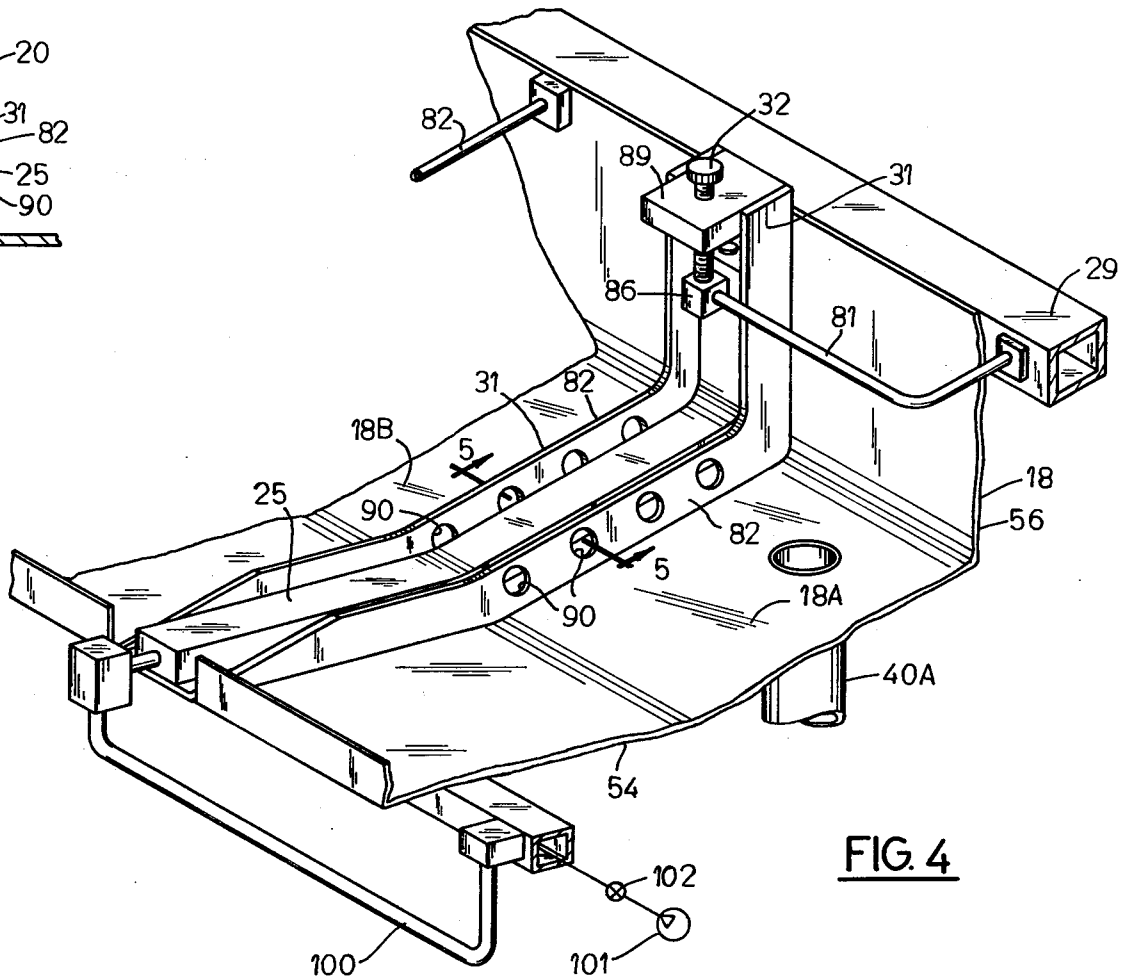
FIG. 4 is an enlarged perspective view of a portion of the ink fountain showing the self-adjusting pneumatic sealing means for the divider.

Each divider 20 is provided along its bottom edge with a compressed air actuated self-adjusting sealing means 25 which is supplied with compressed air from an air manifold 26, shown in FIG. 2, which is supplied from an air pump 54.

PRESS ROLL SUPPORTS, ADJUSTMENT MEANS AND DRIVE MEANS

As FIG. 1 shows, printing cylinder 3 has alignment means 5 on one end thereof and is mounted for rotation on a pair of sliding bearing mounting rails 6, which are air operated and which are provided with manually adjustable stops 7 for making minute settings or adjustments between the impression roll 2 and the printing cylinder 3. The anilox roll 8 is rotatably mounted on sliding bearing mounting rails 10 which are air operated and which have manual adjustment stops 11 for making minute settings or adjustments between the anilox roll 8 and the printing cylinder 3. The sliding bearing mounting rails 10 are associated with a pair of air-operated pivotally movable fountain roll brackets 13 which support fountain roll 15. The brackets 13 are movable by means of air-operated bellows 12. Manual adjustment stops 14 are provided to adjust the bellows 12 and thereby effect minute settings or adjustments between the fountain roll 15 and the anilox roll 8.

It is to be understood that the rolls 2, 3, 8, and 15 are driven by a suitable conventional press drive mechanism (not shown). When the press is ready for a printing operation, all rolls 2, 3, 8, and 15 are in contact and the printing plates 4 on roll 3 receive and transfer ink from the anilox roll 8 to web 1. When the press is in the non-printing condition, the anilox roll 8 is moved by means of the rails 10 out of engagement with the plates 4 on roll 3, but the anilox roll 8 still maintains contact with fountain roll 15 so that any ink in the pockets 9 on anilox roll 8 will not dry and harden. The drive mechanism (not shown) normally drives the press at web speeds of above 75 feet per minute. However, when web speed drops to approximately 75 feet per minute, Sunday drive mechanism 17 automatically comes into play and keeps fountain roll 15 and anilox roll 8 rotating even though the printing press comes to a stop. Such rotation prevents the ink at pockets 9 on anilox roll 8 from hardening since fresh ink is being applied thereto. As this occurs (i.e., as the press stops), the printing cylinder 3 makes four to five final revolutions in order to dry off the printing plates 4 on the web 1. After these final revolutions are completed, the plate roll 3 is moved automatically by movement of its mounting rails 6 away from web 1 and impression cylinder 2.

THE INK FOUNTAIN

As FIGS. 1, 2, 4, and 6 show, ink fountain 18 includes an ink pan 54 above which the fountain roll 15 and the anilox roll 8 are located. Ink pan 54 is closed at its end by end walls 56 and is divided into three separate compartments 18A, 18B, and 18C by the pair of dividers 20. Each divider 20 is supported in a bracket member 31 which has a U-shaped or channel-shaped cross section and which is welded to pan 54 at a desired location. Each bracket 31 also serves to support a pneumatic seal 25 as hereinafter explained. The ink fountain 18 is mounted on the anilox bearing slide rails 10 by bolts 46 which also secure it to the fountain roll mounting rails 47 and 48. This arrangement enables the dividers 20 and the anilox roll 8 to remain in a predetermined relationship with each other. This relationship can be adjusted by means of adjusting screws 21, which control the vertical setting, by means of adjustment screws 22, which control the horizontal setting, and by means of adjustment screws 23, which control the lateral or axial setting. After the components are properly adjusted or set, the fountain roll mounting rails 47 and 48 are secured or clamped together by means of clamps 24.

Each compartment 18A, 18B, 18C of ink fountain 18 is provided with a drain pipe 40A, 40B, 40C, respectively, which connects with a reservoir 41A, 41B, 41C. The drains 40A, 40B, 40C are of such a size that never more than about one-half inch of ink can collect in a section of the pan.

The ink fountain 18 is so designed and constructed as to be easily removable from the press. For example, the top section 20B of the dividers 20 is first removed, as hereinafter explained, and then the fountain roll 15 can be removed. When the drains 40A, 40B, 40C are disconnected, the ink fountain 18 can then be slid outward on the rails 47 and 48 without removing the lower portions 20A of the dividers 20 and with the rubber air seals 25 intact and without removing the anilox roll 8. Once ink fountain 18 is withdrawn, easy replacement of the seals 25, the bottom sections 20A of the dividers 20 and other components is possible. The ink fountain 18, including the ink pan 54, the dividers 20, and the seals 25 are then slid back into the predetermined position determined by the setting of the adjusting screws 21, 22, and 23 and reclamped into place by means of clamps 24. The fountain roll 15 and the top sections 20B of the dividers 20 are then set into place and the press is ready for a printing operation. The dividers 20 are so designed and constructed that the fountain roll 15 can be disengaged from the anilox roll 8 while the settings of the dividers 20 and the settings of the anilox roll 8 are still maintained. As hereinafter explained, the edge 27 of each divider 20 contacts the anilox roll 8 and this edge is also provided with an air flow groove 27A. Futhermore, each divider 20 also has an inner edge 60 around a circular opening 61 which accommodates the fountain roll 15 and the edge 60 extends into a circumferential groove 28 in the fountain roll. However, the edge 60 does not frictionally engage the sides or the bottom of the groove 28 and there is a loose fit for passage of air, as hereinafter explained.

THE INK SUPPLY

Referring now to FIGS. 1, 4, 6, 7, and 8, the ink nozzles 35 A, 35B, and 35C are similar, and each supplies ink to a section 15A, 15B, 15C, respecitvely, of fountain roll 15. Nozzle 35B, for example, includes a member 63 having a trough 64 therein. An adjustable ink deflector 36 is secured by screws 65 and depends into the trough 64 so as to provide an even ink flow during filling of the trough. The discharge side 66 of member 63 is bevelled and ink overflowing from the trough 64 descends by gravity onto a flat rubber deflector 37 which is secured to the underside of member 63 by a back-up stiffener plate 44 and screws 65. Stiffener plate 44 and deflector 37 attached thereto is horizontally adjustable with respect to fountain roll 15 by means of adjusting screws 38 which extend into threaded holes 67 in an adjusting block 45 secured on the underside of plate 44. The block 45, plate 44, and deflector 37 are all movable together as a unit with respect to member 63 and roll 15. Deflector 37 is made of rubber so as not to damage the rubber covering of fountain roll 15 when the latter is in the non-printing position, i.e., when it is moved rightward with respect to FIG. 7. Member 63 of nozzle 35B is mounted on a door plate 39 which is secured to the side 56 of pan 54 by means of screws 70. A seal gasket 43 is disposed between the door 39 and the pan 54. Nozzle 35B can be independently adjusted in a vertical direction or, if necessary, entirely removed from the ink fountain 18 by loosening or removing screws 70. As hereinbefore explained, ink is pumped by pump 50B from reservoir 41B and through filter system 56B, through manual shut-off control valve 34B, and into trough 64 in ink nozzle 35B.

Ink is supplied to the fountain roll 15 in such quantities and at such a rate that the fountain roll 15 does not run in a flooded condition. More specifically, drain 40B in compartment 18B is of such a size as to maintain rapid drainage from the ink pan 54. The return reservoir 41B to which the drain 40B is connected has its own ink overflow drain 42B so as to prevent overflow and intermixing of the different colored inks in the reservoirs 41A, 41B, and 41C.

THE DIVIDERS

Figure 5:
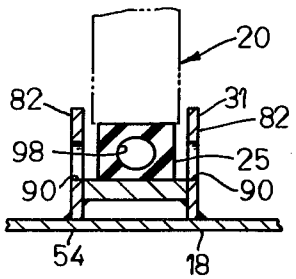
FIG. 5 is an enlarged cross-section view taken on line 5—5 of FIG. 4.
Figure 8:
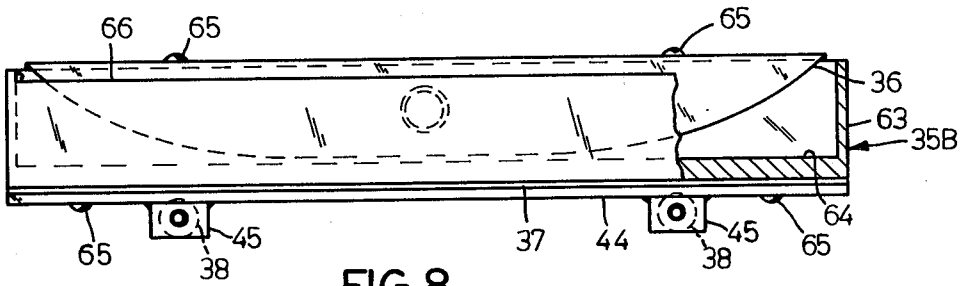
FIG. 8 is an elevational view taken on line 8—8 of FIG. 7.
Figure 7:
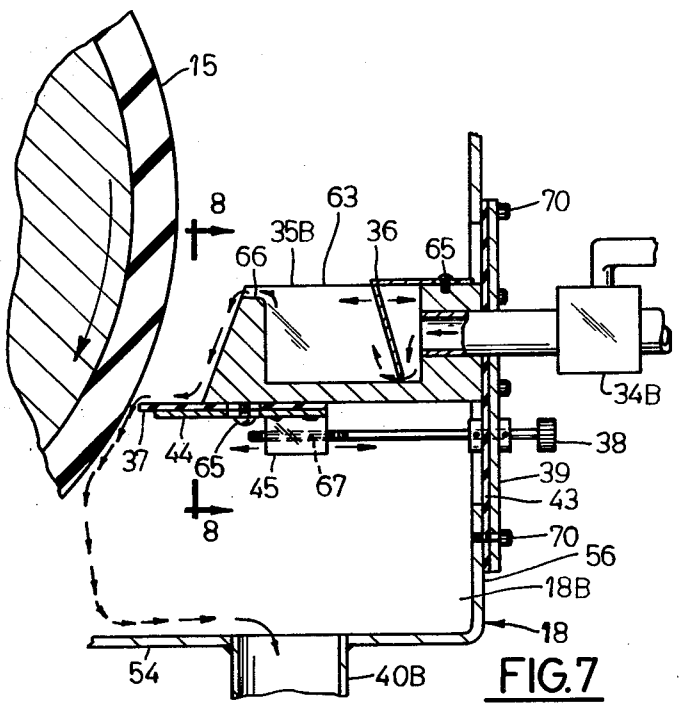
FIG. 7 is an enlarged cross-sectional view of the ink nozzle assembly shown in FIG. 6.
Figure 6:
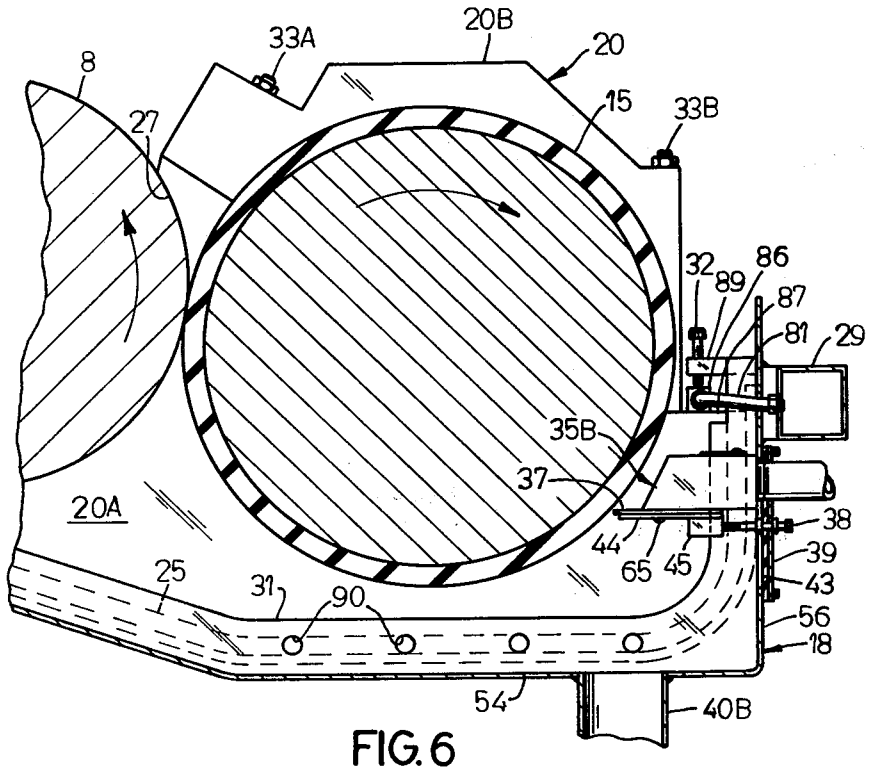
FIG. 6 is an enlarged view, partly in cross section, generally along line 6—6 of FIG. 1.

Referring to FIGS. 1, 2, 3, 4, and 9, each divider 20 is fabricated of high molecular plastic which is mechanically strong, ink and chemical resistant, and has a low coefficient of friction. Each divider 20 comprises a lower section 20A and upper section 20B which are rigidly secured together by means of two bolts 33A and 33B. The lower section 20A and the upper section 20B cooperate to define the circular opening 61 having an edge 60 which accommodates fountain roll 15. Lower section 20A is also provided with a generally semi-circular recess defined by the edge 27 for accommodating anilox roller 8. Lower section 20A is provided with a first air passage 72 formed by drilling and with a plurality of smaller air passages 73, 74, 75 which connect to passage 72 and communicate to atmosphere along the edge 60. Passage 72 also supplies a passage 76 which communicates to atmosphere in air flow groove 27A at the anilox roll 8. Upper section 20B is provided with a second air passage 78 which connects to smaller air passages 79 and 80 along the edges 60 and 27A, respectively. Air is supplied to the passages 72 and 78 through a pair of air supply lines 81 and 82 from air manifold 29 which is rigidly mounted on the outside of ink fountain pan 54. Manifold 29, in turn, is supplied from air pump 52. Lower section 20A of a divider 20 is positioned in ink fountain 18 between the sides 84 of bracket member 31 on top of a sealing member 25 and is secured in place by means of an air connection fitting 86 which is screwed down against a shoulder 87 on lower section 20A by means of a screw 32 which extends through a block 89 rigidly secured as by welding at the upper end of bracket member 31. As FIG. 5 shows, drainage spaces exist between the sides of the divider 20 and the sides 82 of the bracket member 31 and the sides 82 are provided with ink drain holes 90. The upper portion 20B of divider 20 is secured to the lower portion 20A by means of the bolts 33A and 33B which extend through holes 91 and 92, respectively, in upper section 20B and screw into threaded inserts 93 and 94, respectively, force-fitted in holes 95 and 96, respectively, in the lower section 20A. As hereinafter explained, the pneumatic sealing means or member 25 is disposed between the lower edge of divider 20 and ink pan 54. The adjusting screw 32 serves not only to effect a connection between air supply line 81 and air passage 72, but also serves to force air connection fitting 86 against shoulder 87 and thereby maintain the divider 20 pressed against sealing member 25.

The edge 60 around the opening 61 in divider 20 extends into the groove 28 in fountain roll 15 and affords such clearance as to enable the fountain roll 15 to rotate freely. Furthermore, the spacing is such as to permit the fountain roll 15 to be moved slightly (about one-sixteenth inch) to engage and disengage the anilox roll 8, while stil maintaining a positive air seal between the divider 20 and the groove 28 in fountain roll 15 and a mechanical seal between the divider 20 and the anilox roll 8.

Figure 3:
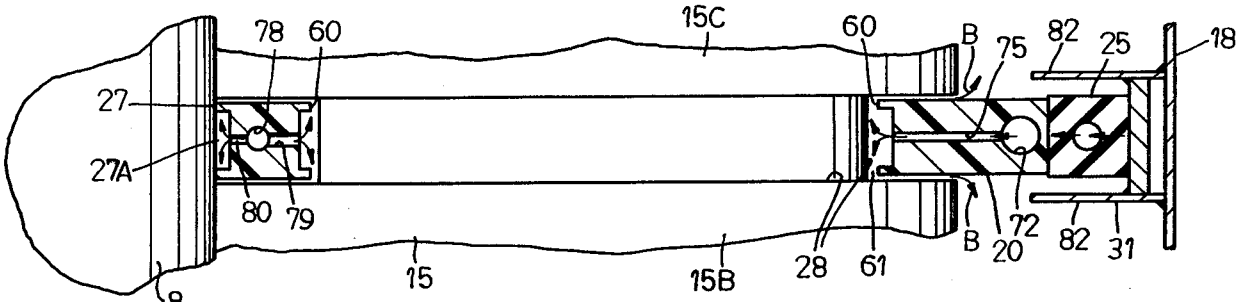
FIG. 3 is an enlarged view, partly in cross section, taken on line 3—3 of FIG. 2.

During operation, air is supplied to a divider 20 from air supply pump 52, through air manifold 29, through air passages 72 and 78, and through the smaller passages 73, 74, 75, 76, 79, and 80. Air discharging from the passages 73, 74, 75 is discharged into groove 28 in fountain roll 15 and as FIG. 3 shows, is eventually expelled from the groove. Air discharged from the passage 79 and 80 into groove 27A along edge 27 eventually reaches atmosphere after leaking out from between the edge 27 and the anilox roll 8. Air pressure at these five openings is on the order of approximately 7 psi.

THE PNEUMATIC SEAL

As FIGS. 1, 2, 3, 4, 5, 6, and 9 show, each pneumatic seal 25 takes the form of an elongated hollow flexible rubber member which has an internal air passage 98 which is closed at one end by means of a plug 99 and which is connected at its other end by means of a hose 100 to air manifold 26. Air for operating each seal 25 is supplied by air pump 101 to air manifold 26 and is delivered at a pressure of about 20 psi. A regulator 102 is provided to enable settings up to 30 psi maximum pressure. Each sealing member 25 air loads its associated divider 20 thereby serving to maintain the desired settings made by the adjustement screws, regardless of wear on the divider 20 along edge 27 caused by frictional engagement of the divider with the periphery of the anilox roll 8.

OPERATION

As explained hereinbefore, each divider 20 cooperates with an associated pneumatic sealing member 25 to provide a fluid-tight seal between two adjacent compartments in the ink pan. Furthermore, each divider 20 cooperates with a groove 28 in fountain roll 15 to provide an air seal between two adjacent sections on the fountain roll 15. As FIG. 3 makes clear, air entering the groove 18 through a passage along the edge 60 forces its way out through the air spaces located between the sides of the groove 28 in the fountain roll 15 and the sides of the divider 20, as indicated by the arrows A in FIG. 3. Also, as FIGS. 2 and 3 make clear, the edge 27 rides against the surface of anilox roll 8 and the space or groove 27A in edge 27 directly confronts a portion of the surface of roll 8. Air from the passages 80 and 76 entering the groove 27A provides an air seal and the edge 27 bearing against roll 8 provides a mechanical seal thereby preventing ink flow past divider 20 along the surface of the anilox roll 8. Air flowing through the passage 75 and indicated by the arrows B in FIG. 3 eventually exits from groove 28 in fountain roll 15. It is most important to maintain air seals in the nip area of the rollers 8 and 15 to prevent lateral displacement of ink along either roll. However, as regards fountain roll 15, an air seal is maintained around the entire circumference thereof between adajcent roll sections. As FIGS. 2 and 6 make clear, each divider extends above the horizontal center line of the anilox roll 8 so as to accommodate or account for the upward carryover of ink due to the rotation of roll 8. As hereinbefore noted, the level of ink in ink pan 54 is below the periphery of the fountain roll 15 so as to reduce the burden on the seal between fountain roll 15 and divider 20. Thus, as hereinbefore explained, ink is applied to fountain roll 15, not by being picked up directly from a supply of ink in the pan 54, but by the ink nozzles 35A, 35B, 35C. Each ink nozzle meters the amount of ink supplied to its associated portion of the fountain roll 15 and the flexible edge plate ensures even distribution along the fountain roll. If preferred, some other manner of applying ink to the fountain roll 15 could be employed such as spraying or the like.

As hereinbefore mentioned, the ink fountain anilox roll 8 and fountain roll 15, as well as the dividers 20, can be moved as a unit to and away from the printing roll 3. Furthermore, since it is sometimes necessary to effect a slight separation between the fountain roll 15 and the anilox roll 8 (on the order of one-sixteenth inch), it is desirable to be able to do so without interrupting the seal between a divider 20 and the ink fountain pan 54, or between the divider 20 and the fountain roll 15, or between the anilox roll 8 and the divider 20. As the two rolls 8 and 15 separate slightly, air pressure in the pneumatic sealing member 25 causes upward movement of divider 20 thereby ensuring that its edge 27 maintains contact with the periphery of anilox roll 8. Such movement is possible because, as FIGS. 2 and 3 make clear, there is radial clearance between the bottom of groove 28 in roll 15 and the circumferential edge 60 in divider 20. Even as divider 20 moves slightly with respect to roll 15, the air seal in groove 28 is maintained but physical contact between the divider 20 and the fountain roll 15 never occurs. In addition, as sealing member 25 expands, it moves the divider 20 upward but still maintains the sealed relationship with the bottom edge thereof.

Dividers such as 20 could be located at the ends of the fountain roll 15 and the anilox roll 8 to serve as end dams and to eliminate ink bead build up at the ends of the rolls which would otherwise be slung off the rolls onto the printing equipment.

We claim:

1. In a printing press:

a roll having two adjacent sections to which ink is applied;

an ink fountain including means for applying ink to said adjacent sections;

and means for preventing ink travel between said adjacent sections of said roll and for dividing said ink fountain into separate compartments, said means comprising:

a circumferential groove in said roll between said two adjacent sections;

a divider comprising at least two separable sections cooperating to define an opening therein for accommodating said roll, said divider completely surrounding said roll and comprising an edge along said opening which extends into and entirely around said groove, said divider further comprising a plurality of spaced apart gas holes near said edge to accommodate passage of compressed gas therethrough into said groove;

and a hollow resilient pneumatically operated sealing tube disposed between at least one of said sections of said divider and said ink fountain and operable to prevent ink flow between said compartments of said ink fountain and to bias said divider toward said roll.

2. In a printing press:

a pair of rolls in contact with each other to enable ink transfer therebetween;

a circumferential groove in one of said rolls dividing said one roll into two sections;

a divider having openings therein for accommodating said rolls, said divider having first and second edges along said openings, one of said edges extending into said groove in said one roll entirely therearound, the other of said edges adjacent the other of said rolls, said other edge having a groove therein, said divider comprising at least two sections cooperating to define the opening having said one of said edges;

said divider having air holes therein terminating at said first and second edges for accommodating the flow of compressed gas therethrough into said circumferential groove and against said other roll to prevent transfer of ink between said two sections of said one roll and across the surface of said other roll.

3. In a printing press:

a first roll;

a second roll in contact with said first roll whereby ink is transferred between said rolls;

a circumferential groove in said first roll dividing said first roll into two sections;

a divider comprising at least two separable sections cooperating to define a first opening therein for accommodating said first roll, said divider comprising a first edge along said first opening which extends into said groove entirely therearound;

said divider having first air holes along said first edge for accommodating the flow of compressed gas therethrough into said groove in said fountain roll to prevent the transfer of ink between said two sections of said first roll;

said divider having a second opening therein for accommodating said second roll, said divider comprising a second edge along said second opening adjacent said second roll, said second edge having a groove therein and having second air holes along said second edge groove for accomodating the flow of compressed gas therethrough against said second roll to prevent the transfer of ink along said second roll past said divider.

4. In a printing press:

a fountain roll having at least one circumferential groove therein for dividing said roll into sections;

an ink fountain associated with said fountain roll and having means for applying different colored inks to different sections of said fountain roll;

an anilox roll to which ink is transferred from said fountain roll;

a plurality of dividers for dividing the ink fountain into separate ink compartments, and for cooperation with said fountain roll and said anilox roll to prevent ink transfer between adjacent sections on each roll, each divider having a hole through which the fountain roll extends, each divider having a circumferential edge around said hole which extends into a groove on said fountain roll, each divider having another edge which rides against said anilox roll, said another edge being provided with a groove therein, a plurality of air ports disposed along said circumferential edge and said other edge and along said groove in said other edge;

means for supplying compressed air for expulsion through said holes;

a resilient hollow pneumatically operated sealing tube disposed between the bottom of each divider and said ink fountain to provide a mechanical seal therebetween and to bias said divider against said anilox roll;

and means for supplying compressed air to said sealing tube.

5. A printing press according to claim 4 wherein each divider comprises a lower section and a detachable upper section and means for releasably securing said lower and upper sections together.

6. A printing press according to claim 5 including means on said ink fountain and on said lower section of said divider for releasably securing said lower section to said ink fountain, and means on said upper and lower sections for releasably securing said upper and lower sections together.

7. A printing press according to claim 5 wherein said means for supplying compressed air for expulsion through said holes comprises passages in said upper section and said lower section of said divider;

a source of compressed air;

at least one air supply line connected between said source and said passages in said divider, said supply line being connected to an air supply fitting;

a screw connected to said ink fountain and bearing against said air supply fitting, said screw being adjustable to connect said fitting to a passage in said lower section of said divider and to force said lower section of said divider against said sealing tube.

* * * * *